US008018317B2

(12) United States Patent
Lindqvist et al.

(10) Patent No.: US 8,018,317 B2
(45) Date of Patent: Sep. 13, 2011

(54) FUSE ARRANGEMENT

(75) Inventors: Lars-Johan Lindqvist, Skien (NO); Ole Granhaug, Skien (NO); Jan-Henrik Kuhlefelt, Skien (NO)

(73) Assignee: ABB Technology AG, Zurich (CH)

( * ) Notice: Subject to any disclaimer, the term of this patent is extended or adjusted under 35 U.S.C. 154(b) by 60 days.

(21) Appl. No.: 11/918,671

(22) PCT Filed: Apr. 18, 2006

(86) PCT No.: PCT/EP2006/003501

§ 371 (c)(1),
(2), (4) Date: Oct. 17, 2007

(87) PCT Pub. No.: WO2006/111339

PCT Pub. Date: Oct. 26, 2006

(65) Prior Publication Data

US 2009/0066471 A1 Mar. 12, 2009

(30) Foreign Application Priority Data

Apr. 18, 2005 (DE) ..... 10 2005 017 903

(51) Int. Cl.

| | |
|---|---|
| ***H01H 85/20*** | (2006.01) |
| ***H01H 71/20*** | (2006.01) |
| ***H02B 5/00*** | (2006.01) |
| ***H02B 7/00*** | (2006.01) |

(52) U.S. Cl. ..... 337/283; 337/186; 337/178; 337/293; 361/605; 200/50.21

(58) Field of Classification Search ..... 337/283, 337/293, 186, 178; 361/605; 200/50.21
See application file for complete search history.

(56) References Cited

U.S. PATENT DOCUMENTS

| | | | | | |
|---|---|---|---|---|---|
| 2,222,642 | A | * | 11/1940 | Xenis | 337/192 |
| 2,259,053 | A | * | 10/1941 | Xenis | 337/159 |
| 2,267,006 | A | * | 12/1941 | Xenis | 337/188 |
| 2,268,911 | A | * | 1/1942 | Triplett | 337/287 |
| 3,054,874 | A | * | 9/1962 | Dickinson et al. | 337/146 |
| 3,171,926 | A | * | 3/1965 | Schwab | 337/7 |

(Continued)

FOREIGN PATENT DOCUMENTS

DE 11 26 976 B 4/1962

(Continued)

OTHER PUBLICATIONS

International Search Report for PCT/EP2006/003501, dated Jul. 13, 2006.

(Continued)

*Primary Examiner* — Jayprakash N Gandhi
*Assistant Examiner* — Bradley H Thomas
(74) *Attorney, Agent, or Firm* — Buchanan Ingersoll & Rooney PC

(57) ABSTRACT

The invention relates to a fuse system for a switchgear assembly, especially for a medium voltage switchgear assembly. The fuse system comprises a plurality of fuses which correspond to the number of phases, every fuse having a tripping bar that projects from the face of the fuse under the effect of the force of a spring when the fuse comes into action. A sealing body, with a spring arrangement interposed, pushes a sealing head into the interior of a receptacle receiving the fuse. A two-armed lever is received on the sealing head, one arm covering a tripping mechanism which actuates a power switch.

4 Claims, 1 Drawing Sheet

U.S. PATENT DOCUMENTS

| | | | | | |
|---|---|---|---|---|---|
| 3,236,967 | A | * | 2/1966 | Peppel et al. | 335/69 |
| 3,274,356 | A | * | 9/1966 | Godfrey | 337/189 |
| 3,339,118 | A | * | 8/1967 | Harner et al. | 361/609 |
| 3,480,899 | A | * | 11/1969 | Laakso | 337/6 |
| 3,573,560 | A | * | 4/1971 | Rogers | 361/609 |
| 3,576,509 | A | * | 4/1971 | Bernatt | 337/8 |
| 3,579,045 | A | * | 5/1971 | Keogh et al. | 361/615 |
| 3,748,621 | A | * | 7/1973 | Sakats | 337/173 |
| 3,790,861 | A | * | 2/1974 | Sakats | 361/609 |
| 3,842,381 | A | * | 10/1974 | Bernatt et al. | 337/7 |
| 3,868,617 | A | * | 2/1975 | Dragon et al. | 337/203 |
| 3,991,348 | A | * | 11/1976 | Evans | 361/621 |
| 4,083,028 | A | * | 4/1978 | Haubein et al. | 337/144 |
| 4,233,643 | A | * | 11/1980 | Iverson et al. | 361/616 |
| 4,250,357 | A | * | 2/1981 | Hanke | 200/50.07 |
| 4,301,341 | A | * | 11/1981 | Parry | 218/28 |
| 4,336,520 | A | * | 6/1982 | Trayer | 337/191 |
| 4,351,994 | A | * | 9/1982 | Evans et al. | 200/400 |
| 4,463,227 | A | * | 7/1984 | Dizon et al. | 200/50.07 |
| 4,491,898 | A | * | 1/1985 | Hillman et al. | 361/835 |
| 4,688,143 | A | * | 8/1987 | Beard | 361/605 |
| 4,688,145 | A | * | 8/1987 | Mikulecky | 361/630 |
| 4,689,716 | A | * | 8/1987 | Cooper et al. | 361/837 |
| 4,777,559 | A | * | 10/1988 | Bar et al. | 361/610 |
| 4,791,530 | A | * | 12/1988 | Kalvaitis et al. | 361/600 |
| 4,798,922 | A | * | 1/1989 | Roberts | 200/400 |
| 4,827,374 | A | * | 5/1989 | Dunn | 361/617 |
| 5,001,600 | A | * | 3/1991 | Benson | 361/610 |
| 5,181,158 | A | * | 1/1993 | Goe et al. | 361/605 |
| 5,424,500 | A | * | 6/1995 | Smith | 200/50.17 |
| 5,450,280 | A | * | 9/1995 | Wactor | 361/606 |
| 5,475,570 | A | * | 12/1995 | Harr | 361/825 |
| 5,521,567 | A | * | 5/1996 | Devonald et al. | 335/132 |
| 5,757,260 | A | * | 5/1998 | Smith et al. | 337/186 |
| 5,835,002 | A | * | 11/1998 | Barnett | 337/143 |
| 5,969,308 | A | * | 10/1999 | Pever | 200/15 |
| 5,990,439 | A | * | 11/1999 | Pever | 218/156 |
| 6,512,669 | B1 | * | 1/2003 | Goodwin et al. | 361/601 |
| 6,545,859 | B2 | * | 4/2003 | Leccia | 361/607 |
| 6,687,110 | B2 | * | 2/2004 | Murray | 361/131 |
| 6,727,442 | B2 | * | 4/2004 | Byron et al. | 200/50.27 |
| 7,301,433 | B2 | * | 11/2007 | Glass | 337/191 |
| 2008/0067152 | A1 | * | 3/2008 | Kikukawa et al. | 218/139 |

FOREIGN PATENT DOCUMENTS

| | | | |
|---|---|---|---|
| DE | 12 46 081 | B | 8/1967 |
| DE | 83 37 368.3 | U1 | 3/1984 |
| DE | 10 2005 009 235 | A1 | 8/2006 |
| EP | 0 617 448 | A | 9/1994 |

OTHER PUBLICATIONS

German Search Report dated Nov. 16, 2006.

* cited by examiner

FUSE ARRANGEMENT

TECHNICAL FIELD

The invention relates to a fuse arrangement according to the precharacterizing clause of claim 1.

BACKGROUND OF THE INVENTION

DE 10 2005 009 235.7 has disclosed a fuse arrangement in which each fuse is accommodated within a cylindrical container, a sealing body being provided so as to seal off the cylinder body, which sealing body is pressed into the interior of the insulating body by a sealing head, with a plate spring interposed.

Each fuse has, as is described in the German patent application, a tripping bar, which moves outwards when the fuse responds and in this way actuates a tripping mechanism.

BRIEF SUMMARY OF THE INVENTION

The object of the invention is to specify a tripping mechanism which has a very simple design.

This object is achieved according to the invention by the features of claim 1.

Therefore according to the invention a twin-armed lever is mounted on the sealing head, one arm of said twin-armed lever covering the tripping bar of the fuse and its other arm unlatching a tripping mechanism, with which a circuit breaker can be driven.

As can be gleaned from the abovementioned patent application, two fuses are arranged one above the other, with the result that their mid-axes cover a vertical plane with one another.

Parallel to the vertical plane, a transmission rod is mounted such that it can rotate about its vertical axis, pins being arranged on said transmission rod which protrude at right angles thereto and interact with the second lever arm of the twin-armed lever, with the result that the transmission rod is rotated when the tripping bar is moved out.

If the fuses are arranged at the corner of a triangle, a further transmission rod is located on the opposite side, which transmission rod is coupled to the twin-armed lever of the adjacent fuse in such a way that the further transmission rod is rotated when the tripping bar is moved out.

In accordance with a further embodiment of the invention, in each case one arm is fixed on the transmission rods so as to protrude radially, the free ends of said arm being coupled to one another by a coupling rod, which can be displaced by in each case one arm during the tripping operation; the latching point of the tripping mechanism is then coupled to the coupling rod via an intermediate element.

BRIEF DESCRIPTION OF THE DRAWING

Exemplary embodiments and further advantageous configurations and improvements and further advantages will be explained and described in more detail with reference to the drawing, in which an exemplary embodiment of the invention is illustrated and in which the single FIGURE shows a perspective plan view of a fuse arrangement for an electrical switchgear assembly with a tripping mechanism.

In FIG. 5 of DE 10 2005 009 235.7, which has already been mentioned above, a holding plate 100 for mounting the sealing head 43 is provided for each fuse, with which holding plate the sealing head (the sealing head 43 according to the abovementioned DE 10 2005 009 235.7), which is not illustrated in the single FIGURE here, is pressed into the interior of each fuse container 30. In this context, reference is made to DE 10 2005 009 235.7.

DETAILED DESCRIPTION OF THE INVENTION

Figure 1:
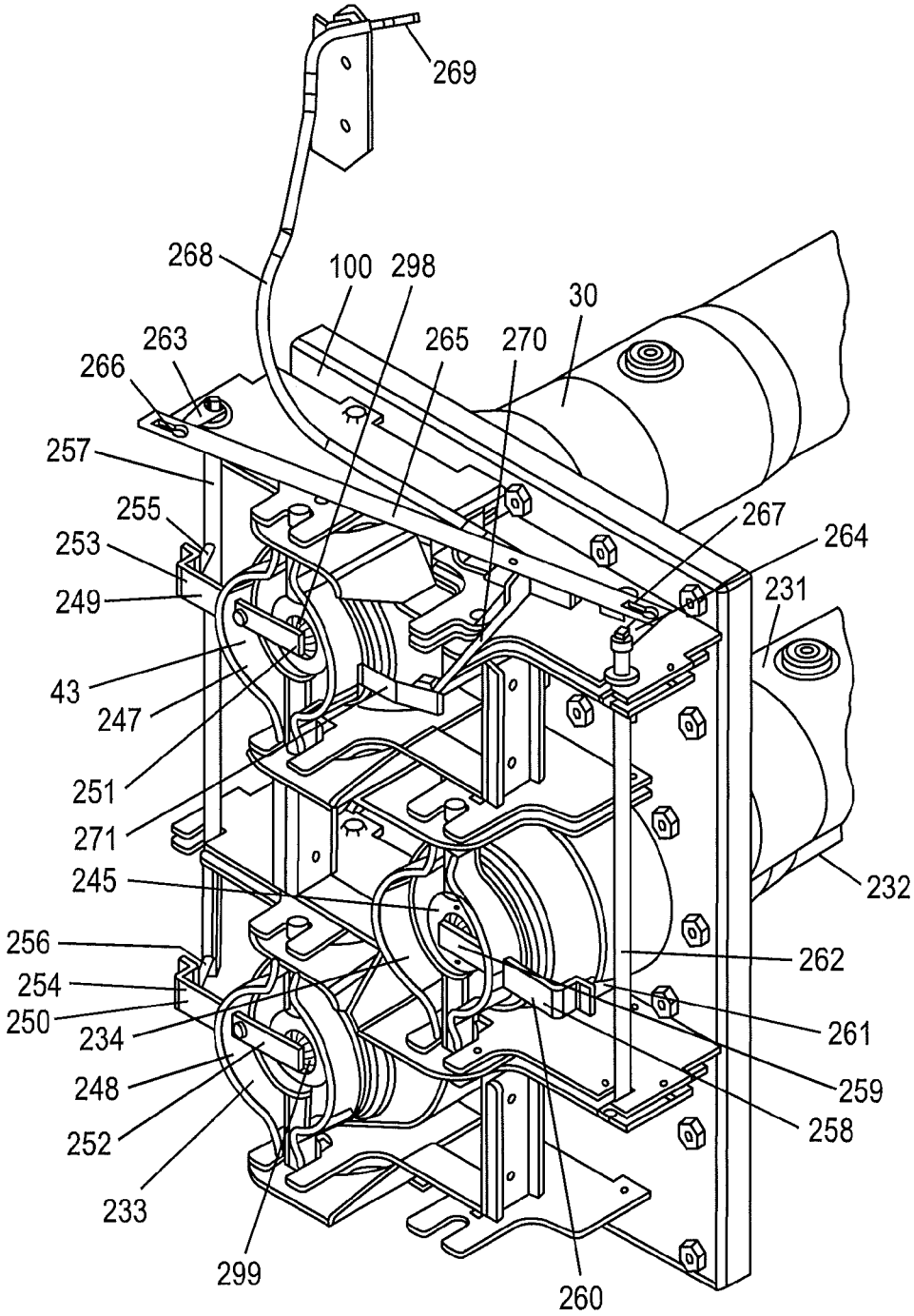

In the embodiment according to the present invention, three fuses 30, 231 and 232 are provided corresponding to the number of phases, the mid-axes of said fuses running horizontally and being arranged at the corners of a triangle. In this case, the fuses 30, 232 are located one above the other in a vertical plane, whereas the third fuse 231 is positioned at the apex of the triangle, of which the plane of the two fuses 30, 232 forms the base.

The sealing heads 43, 233 and 234 are in the form of pots, the base of each sealing head being directed towards the fuse container 30, 231, 232.

Mounted in the walls 247, 248 of the sealing heads 43, 233 which lie one above the other are twin-armed levers 249 and 250, which pass through an opening (not given a designation) in the walls 43, 233. The inner arm 251 and 252 covers the respective tripping bar 298 and 299 of the fuse and the arms 253 and 254, which are located outside of the walls 43, 233, are bent back approximately in the form of an L and interact with pins 255 and 256, which are fixed on a first transmission rod 257 so as to protrude radially.

Mounted on the sealing head 234, which is likewise in the form of a pot, is likewise a twin-armed lever 258, whose one lever arm 259 engages over the tripping bar of the fuse 231, whereas the other arm 260 is bent back in the same way as the arms 253 and 254, the arm 260 interacting with a radially protruding pin 261 on a second transmission rod 262.

The twin-armed levers 249, 250 and 258 run horizontally and can be pivoted in each case about a vertically running axis in the walls of the sealing heads. The transmission rod 257 is located on one side of the triangle, outside the triangle, parallel to the base of the triangle, whereas the other transmission rod 262 is arranged on the opposite side, i.e. the apex side of the triangle. The two transmission rods 257 and 262 run at right angles and in a plane, which runs parallel to the plane of the plate 100.

Lever arms 263 and 264, whose free ends are coupled by a coupling rod 265, are fixed at the upper ends of the transmission rods 257 and 262, the coupling rod 265 running at an angle with respect to the plane in which the transmission rods 257 and 262 are located. In this case, the free end of the lever arm 263 points away from the plate 100; the free end of the lever arm 264 points towards the plate 100 with the result that the end of the coupling rod, which is connected to the arm 264, has a shorter distance than the other end of the coupling rod 265, which is connected to the arm 263.

The free ends of the lever arms 263 and 264 are coupled to one another via a slot 266 and 267, the coupling bolts (no reference numerals) in the tripping-ready position shown in FIG. 1 bearing against one end of the slots.

If the fuse 231 should now respond, the twin-armed lever 258 actuates the transmission rod 262 via the pin 261 in the clockwise direction, as a result of which the lever arm 264 pivots and exerts a force on the coupling rod 265 so as to displace it, the coupling rod 265 being freely movable owing to the slot 266. On the other hand, if, owing to the response of the fuse 30, the transmission rod located on the left-hand side in the drawing is pivoted counter to the clockwise direction, the lever arm 263 displaces the coupling rod 265, and the coupling rod 265 can move freely, i.e. independently of the position of the transmission rod 262, owing to the slot 267.

Connected to the coupling rod 265 is a Bowden cable 268, via which the movement of the coupling rod acts on a tripping element 269 in the latching point of a switching mechanism.

An indicating rod 270 is fixed to the coupling rod 265, and an indicating lug 271 is fixed to its free end, which indicating lug 271 indicates the switching position or the tripping position of the fuses, i.e. indicates whether a fuse has responded.

As an indication that the abovementioned German patent application is to a certain extent the basis for the present patent application, the reference numerals 43, 30, 100 have been selected to be the same.

In addition it is also mentioned that the transmission rods 257 and 262 are axially undisplaceable, but are mounted such that they can rotate about their vertically running mid-axis.

The invention claimed is:

1. A fuse arrangement for a switchgear assembly, the fuse arrangement comprising:

plural fuses, a number of the fuses corresponding to a number of phases, wherein each fuse of the plural fuses has a sealing head for pressing a sealing body into an interior of a container accommodating the fuse;

a twin-armed lever mounted on a wall of the sealing head;

a tripping bar arranged under one arm of the twin-armed lever;

wherein when the fuse responds, the tripping bar moves out of a front face of the fuse under a force of a spring and actuates the twin-armed lever through the arm that is arranged above the tripping bar, and the other arm of the actuated twin-armed lever unlatches a tripping mechanism to cause a circuit break.

2. The fuse arrangement as claimed in claim 1, in which at least two fuses of the plural fuses are arranged in a vertical plane one above the other, wherein a transmission rod is mounted, parallel to the vertical plane, such that the transmission rod can rotate about its vertical axis, wherein pins arranged on the transmission rod protrude at right angles thereto and interact with the other arm of the twin-armed levers of the at least two fuses, for rotating the transmission rod when at least one of the tripping bars of the at least two fuses is moved out.

3. The fuse arrangement as claimed in claim 2, in which the fuses are arranged at corners of a triangle shape, wherein the twin-armed levers of two of the fuses interact with the transmission rod, and a further transmission rod is provided on the opposite side between the two fuses lying in the vertical plane, and wherein the further transmission rod is coupled to the twin-arm lever of a third fuse of the plural fuses by a pin arranged on the further transmission rod in such a way that the further transmission rod is rotated when the tripping bar of the third fuse is moved out.

4. The fuse arrangement as claimed in claim 1, wherein each of a plurality of transmission rods has one transmission arm protruding radially, transmission arms of the transmission rods being coupled to one another by a coupling rod, which can be displaced during unlatching of the tripping mechanism, and a latching point of the tripping mechanism is coupled to the coupling rod via an intermediate element.

* * * * *